US008932092B1

(12) United States Patent
Sadowski

(10) Patent No.: US 8,932,092 B1
(45) Date of Patent: Jan. 13, 2015

(54) WATERJET PROPULSOR WITH SHAFT FAIRING DEVICE

(71) Applicant: Thaddeus J. Sadowski, Hampton, VA (US)

(72) Inventor: Thaddeus J. Sadowski, Hampton, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/920,214

(22) Filed: Jun. 18, 2013

(51) Int. Cl.
*B63H 11/00* (2006.01)
*B63H 11/08* (2006.01)

(52) U.S. Cl.
CPC ..... *B63H 11/08* (2013.01); *B63H 2011/081* (2013.01)
USPC ..... 440/38; 440/83

(58) Field of Classification Search
USPC ..... 114/243; 440/38, 66, 83
IPC ..... B63H 11/08
See application file for complete search history.

(56) References Cited

U.S. PATENT DOCUMENTS

| | | | | |
|---|---|---|---|---|
| 1,104,254 | A * | 7/1914 | Eddelbuttel-Reimers | 244/130 |
| 4,470,364 | A * | 9/1984 | Kitaura et al. | 114/151 |
| 4,854,903 | A * | 8/1989 | Sirois | 440/83 |
| 5,232,386 | A * | 8/1993 | Gifford | 440/80 |
| 5,722,340 | A * | 3/1998 | Sweetman | 114/243 |
| 5,839,927 | A | 11/1998 | Thomas et al. | |
| 6,244,204 | B1 | 6/2001 | Weyman | |
| 6,913,496 | B2 | 7/2005 | Fuse et al. | |
| 7,837,524 | B2 * | 11/2010 | Tesvich | 440/83 |
| 7,988,421 | B2 | 8/2011 | Bakhuis et al. | |
| 8,162,705 | B2 * | 4/2012 | Koide et al. | 440/38 |
| 2003/0027467 | A1 * | 2/2003 | Suits | 440/83 |
| 2012/0083172 | A1 * | 4/2012 | Al Babtain | 440/6 |
| 2014/0087608 | A1 * | 3/2014 | Nere et al. | 440/66 |

* cited by examiner

*Primary Examiner* — Stephen Avila
(74) *Attorney, Agent, or Firm* — Dave A. Ghatt

(57) ABSTRACT

The invention is directed to a waterjet propulsor. The propulsor includes a structure covering an impeller shaft. The implementation of the elongated structure results in reduced drag, increased thrust and increased craft speed. The elongated structure may be a sleeve that is mounted in a free-floating arrangement over the impeller shaft that self-aligns, the sleeve having an airfoil cross section for optimizing the flow of water over the shaft. The elongated structure may also be a fixed housing arrangement that includes an airfoil cross section for optimizing the flow of water over the shaft.

16 Claims, 13 Drawing Sheets

315
41
20
80
30
300
20
40
X
Y 315
41
20
80
30
300
20
40
X
Y 315
41
20
80
30
D'
D
300
20
40
X
Y

WATERJET PROPULSOR WITH SHAFT FAIRING DEVICE

STATEMENT OF GOVERNMENT INTEREST

The following description was made in the performance of official duties by employees of the Department of the Navy, and thus, the claimed invention may be manufactured, used, licensed by or for the United States Government for governmental purposes without the payment of any royalties thereon.

TECHNICAL FIELD

The following description relates generally to a waterjet propulsor, more particularly, an elongated sleeve or housing covering the impeller shaft, the elongated sleeve or housing being free-floating or fixed, and having an airfoil section for optimizing the flow over the shaft, thereby increasing propulsive efficiency.

BACKGROUND

The efficiency of existing marine waterjet propulsor designs are limited and optimum efficiency has to be tailored to a specific operating condition of the marine vehicle in which the propulsor is to be installed. The efficiency ofpropulsors vary with vehicle speed and decreases substantially at off-design conditions, particularly at lower craft speeds. Even while operating at optimum efficiency and the intended design conditions, existing waterjet designs suffer from areas of poor flow quality, uneven pressure distributions, flow circulation, flow separation and impeller cavitation. These undesirable attributes limit fluid mass flow and velocity, thereby reducing potential thrust for any given power input. Many of these effects are directly attributable to the multitude of negative influences arising from the positioning and geometry of the waterjet impeller shaft.

FIG. 8A is a prior art illustration of a typical waterjet propulsor 10. As shown, the propulsor 10 includes an impeller shaft 20 with impeller blades 30 and impeller hub 80. The shaft 20 has a substantially circular cross section, and is mounted at the forward end via a forward bearing arrangement 40 to the propulsor frame structure 50. The shaft is mounted at the aft end via an aft bearing arrangement 41 to the stator/nozzle assembly 70. FIG. 8A also shows the intake 60, through which the propulsor inlet flow is developed. As shown, the shaft 20 is situated entirely within the flow field, indicated by arrows F, created upstream of the impeller. The shaft 20 presents an obstruction to flow creating turbulence and a large wake region within the housing of the propulsor, downstream of the shaft. This introduces turbulence and extreme variations in the velocities and pressures of the flow field entering the plane of the impeller blades 30.

The turbulence introduced is due to the location of the shaft, the shape of the shaft, and the rotational movement of the shaft. As shown in FIG. 8A, the impeller shaft 20 is positioned directly in the path of the intake fluids, thereby obstructing the flow into the impeller blades 30. Being a right circular cylinder, the cross sectional shape of the impeller shaft 20 possesses one of the highest drag coefficients for a non-blunt object. FIG. 8B shows the character of the drag coefficient as a function of Reynolds number for fluid flow over objects of different cross-sectional shapes, including that of a circle and an ellipse. It should be noted that in actuality, because of the angle β (shown in FIG. 8A) at which the flow approaches the shaft 20, the shaft cross section over which flow occurs may be more akin to an ellipse, which is more efficient than a circle, but less efficient than an airfoil.

Additionally, as opposed to the simple case of flow over an immersed stationary cylinder or ellipse, the surface of shaft 20 is not stationary, but rotating. Consequently, additional detrimental boundary layer effects associated with the tangential velocity of the shaft surface are introduced due to the shaft rotation (Magnus effect). The prior art does not provide a propulsor structure that minimizes the deleterious effects of the shaft to optimize the operation of the propulsor.

SUMMARY

In one aspect, the invention is a waterjet propulsor having a frame with a forward end, an aft end, an upper end, and a lower end. The waterjet propulsor also has a nozzle assembly located at the aft end of the frame. In this aspect, the waterjet propulsor also includes an impeller assembly. The impeller assembly has a forward impeller bearing arrangement at the forward end of the frame, an aft impeller bearing arrangement at the aft end of the frame, and an impeller shaft extending from the forward end of the frame to the aft end of the frame in a longitudinal direction X and mounted within each of the forward impeller bearing arrangement and the aft impeller bearing arrangement. The impeller assembly also includes an impeller blade assembly having a central hub and a plurality of blades attached to the central hub, wherein the central hub is supported on the impeller shaft. In this aspect, the waterjet propulsor has a water intake extending from the lower end of the frame towards the impeller, the water intake having intake walls forming a conduit, wherein the conduit is angled to create an intake flow $F_I$ having flow vectors in perpendicular X, Y, and Z axes, and wherein intake flow $F_{I\text{-}xy}$ in the X-Y plane impinges on the impeller shaft at an angle α with respect to the longitudinal direction X of the shaft. The invention also includes an elongated structure positioned over the impeller shaft, wherein the elongated structure has an airfoil cross section in the Y-Z plane. The elongated structure also has an offset streamlined airfoil cross section aligned with the intake flow angle α, so that the intake flow $F_{I\text{-}xy}$ flows over the elongated structure in a path defined by the offset streamlined airfoil cross section, thereby minimizing the deleterious flow effects caused by the shaft, and increasing the efficiency of the propulsor.

In another aspect, the invention is a method of optimizing the flow within a waterjet propulsor. The method includes the step of providing a waterjet propulsor having a frame having a forward end, an aft end, an upper end, and a lower end. The waterjet propulsor is also provided with a nozzle assembly located at the aft end of the frame, and an impeller assembly. The impeller assembly includes a forward impeller bearing arrangement at the forward end of the frame, an aft impeller bearing arrangement at the aft end of the frame, an impeller shaft extending from the forward end of the frame to the aft end of the frame in a longitudinal direction X and mounted within each of the forward impeller bearing arrangement and the aft impeller bearing arrangement. In this aspect, the impeller assembly includes an impeller blade assembly having a central hub and a plurality of blades attached to the central hub, wherein the central hub is supported on the impeller shaft. In this aspect, the propulsor also includes a water intake extending from the lower end of the frame towards the impeller, the water intake having intake walls forming a conduit, wherein the conduit is angled to create an intake flow $F_I$ having flow vectors in perpendicular X, Y, and Z axes. The method further includes the step of providing an elongated structure positioned over the impeller shaft, wherein the elongated structure has an airfoil cross section in the Y-Z plane. The method also includes the directing of the intake flow $F_I$ having intake flow vector $F_{I\text{-}xy}$ in the X-Y plane into the waterjet propulsor, the intake flow $F_{I\text{-}xy}$ impinging on the impeller shaft at an angle $\alpha$ with respect to the longitudinal direction X of the shaft. The elongated structure further comprises an offset streamlined airfoil cross section aligned with the intake flow angle $\alpha$, so that the intake flow $F_{I\text{-}xy}$ flows over the elongated structure in a path defined by offset streamlined airfoil cross section, thereby minimizing the deleterious flow effects caused by the shaft, and increasing the efficiency of the propulsor.

In another aspect, the invention is an elongated sleeve for optimizing flow in a waterjet propulsor having a frame with a forward end, an aft end, an upper end, and a lower end, a nozzle assembly located at the aft end of the frame, and an impeller assembly. The impeller assembly has a forward impeller bearing arrangement at the forward end of the frame, an aft impeller bearing arrangement at the aft end of the frame, an impeller shaft extending from the forward end of the frame to the aft end of the frame in a longitudinal direction X and mounted within each of the forward impeller bearing arrangement and the aft impeller bearing arrangement. The impeller assembly also includes an impeller blade assembly having a central hub and a plurality of blades attached to the central hub, wherein the central hub is supported on the impeller shaft. The waterjet propulsor also has a water intake extending from the lower end of the frame towards the impeller, the water intake having intake walls forming a conduit, wherein the conduit is angled to create an intake flow $F_I$ having flow vectors in perpendicular X, Y, and Z axes, and wherein intake flow $F_{I\text{-}xy}$ in the X-Y plane impinges on the impeller shaft at an angle $\alpha$ with respect to the longitudinal direction X of the shaft, the elongated sleeve positioned over the impeller shaft and having an airfoil cross section in the Y-Z plane, the elongated sleeve further having an NACA 0030 offset streamlined airfoil cross section aligned with the intake flow angle $\alpha$, so that the intake flow $F_{I\text{-}xy}$ flows over elongated sleeve in a path defined by offset streamlined airfoil cross sections, thereby minimizing the deleterious flow effects caused by the shaft, and increasing the efficiency of the propulsor.

BRIEF DESCRIPTION OF THE DRAWINGS

Other features will be apparent from the description, the drawings, and the claims.

DETAILED DESCRIPTION

Figure 1:
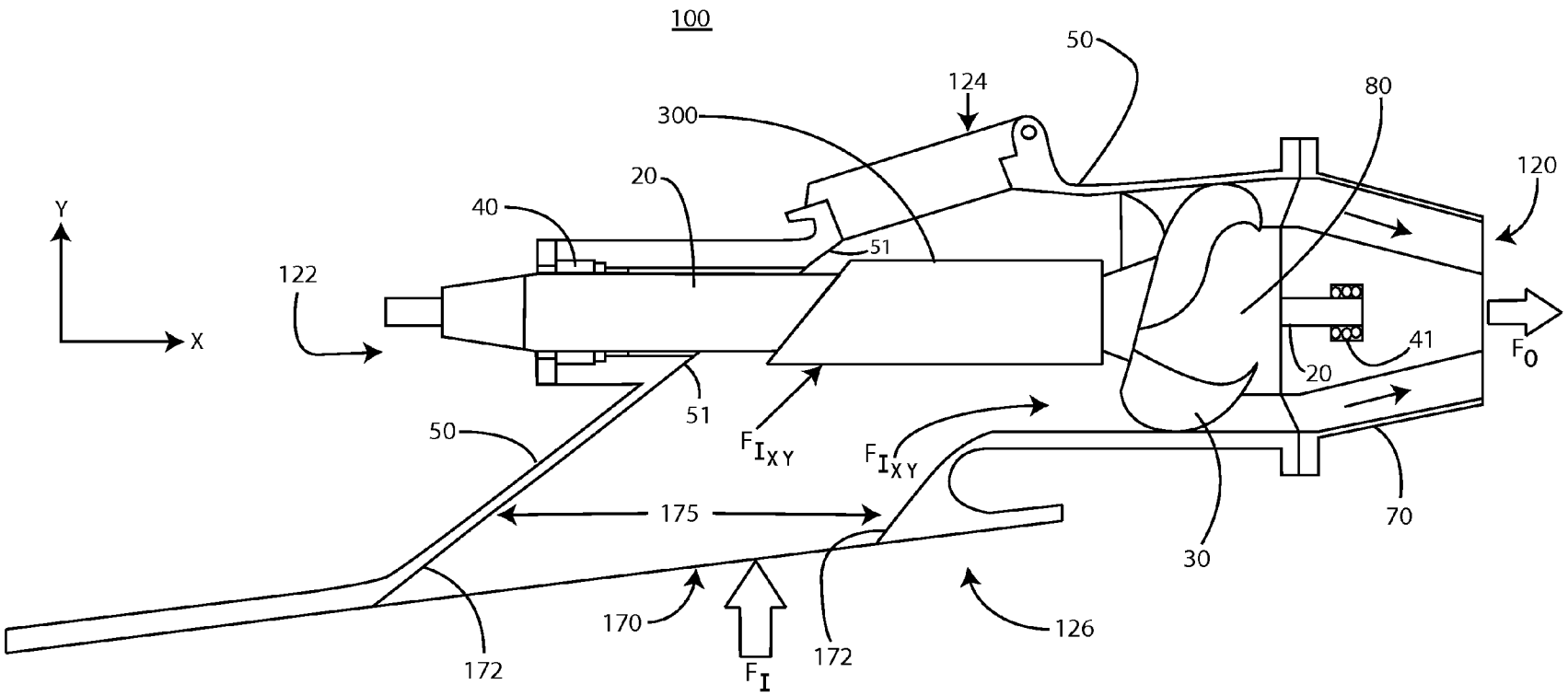
FIG. 1 is an exemplary illustration of an optimized waterjet propulsor, according to an embodiment of the invention.

FIG. 1 is an exemplary illustration of an optimized waterjet propulsor 100, according to an embodiment of the invention. As shown, the propulsor 100 includes having a frame structure 50 and stator/nozzle assembly 70. The frame structure 50 has an aft end 120, a forward end 122, an upper end 124, and a lower end 126. The waterjet propulsor 100 includes an impeller assembly, having an impeller shaft 20, with a central impeller hub 80 and impeller blades 30 mounted on the hub 80. The impeller shaft 20, which has a circular cross section, extends longitudinally in an X-direction from the forward end 122 to the aft end 120 of the frame 50. The shaft 20 is supported within the chassis via a forward impeller bearing arrangement 40 at the forward end 122. The shaft 20 is also supported within the stator/nozzle assembly 70 at the aft end 120 by an aft impeller bearing assembly 41.

As illustrated, the propulsor 100 includes an intake 170 located at the lower end 126 of the frame. FIG. 1 shows intake walls 172 forming an angled intake conduit 175. FIG. 1 also shows a stator/nozzle assembly 70 located at the aft end 120 of the propulsor 100. Arrow $F_1$ shows the intake flow of water entering the waterjet propulsor, as water enters through the intake 170. The intake flow $F_I$ includes flow vectors in the three perpendicular directions X, Y, and Z. The intake flow $F_{I\text{-}xy}$ shown represents the flow vectors in the X-Y plane. The flow vectors in a Z direction are not illustrated in FIG. 1. Because of the orientation of the intake walls 172 and conduit 175 formed therebetween, the intake flow $F_{I\text{-}xy}$ approaches the elongated sleeve 300 (which covers the impeller shaft 20) at an angle in the X-Y plane, as opposed to directly in the Y-direction. Arrows $F_O$ represent the outflow of water that passes through the stator/nozzle assembly 70. The outflow $F_O$ shown is the output flow and also includes flow vectors in the three perpendicular X, Y, and Z axes. The $F_{O\text{-}xy}$ arrow shows the outflow in the X-Y plane. As stated above, the flow vectors in a Z direction are not illustrated in FIG. 1.

Figure 3A:
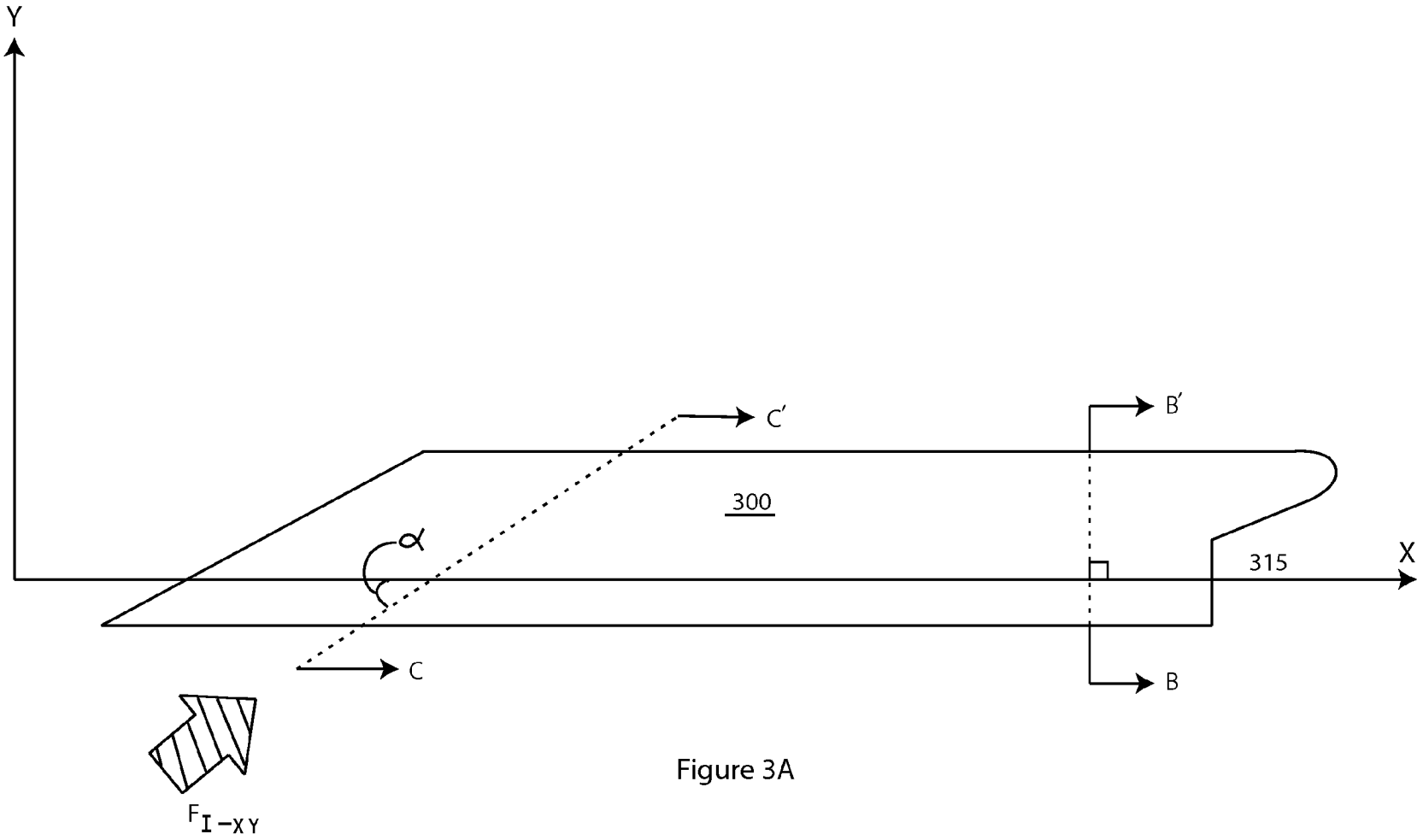
FIG. 3A is an exemplary illustration of an elongated sleeve, showing the angular relation between the elongated sleeve and the intake flow path, according to an embodiment of the invention.
Figure 3B:
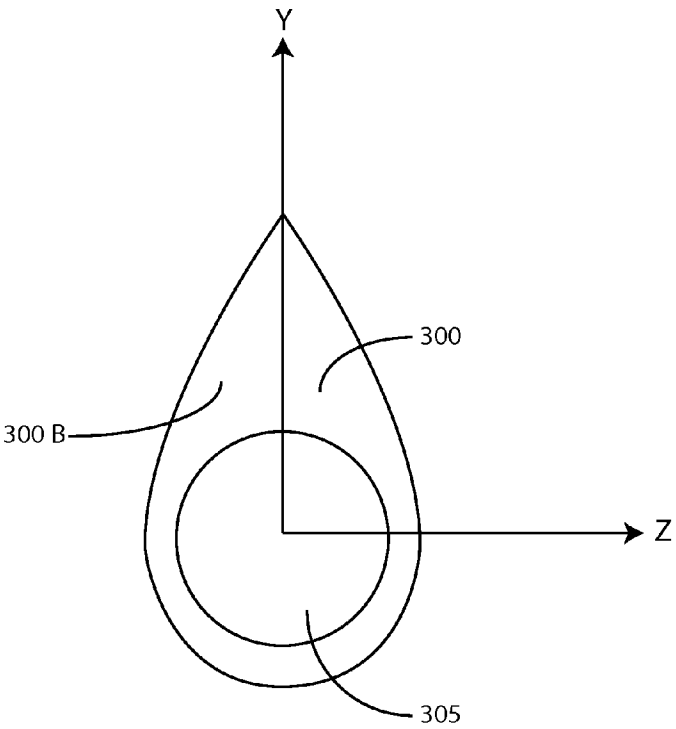
FIG. 3B is an exemplary sectional taken through line B-B' of FIG. 3A, according to an embodiment of the invention.

As shown, a large portion of the intake flow $F_{I\text{-}xy}$ is interrupted by the presence of the elongated sleeve 300 which extends into the $F_{I\text{-}xy}$ path. FIG. 1 shows an elongated sleeve 300, positioned over the shaft 20. As outlined below, the sleeve 300 is mounted to rotate freely with respect to the shaft 20, and as shown in FIG. 3B, the elongated sleeve 300 has a geometry having an airfoil cross section in the Y-Z plane. As outlined below, the elongated sleeve 300 also includes an offset streamlined airfoil cross section aligned with the intake flow $F_{I\text{-}xy}$ path, so that the intake flow $F_{I\text{-}xy}$ flows over the elongated structure in a path defined by the offset streamlined airfoil cross section, thereby minimizing the deleterious flow effects caused by the shaft, and increasing the efficiency of the propulsor. Also outlined below is the rotational adjustability of the elongated sleeve 300 in the Y-Z plane, thereby aligning the elongated sleeve with intake flow.

Figures 2A, 2B, 2C:
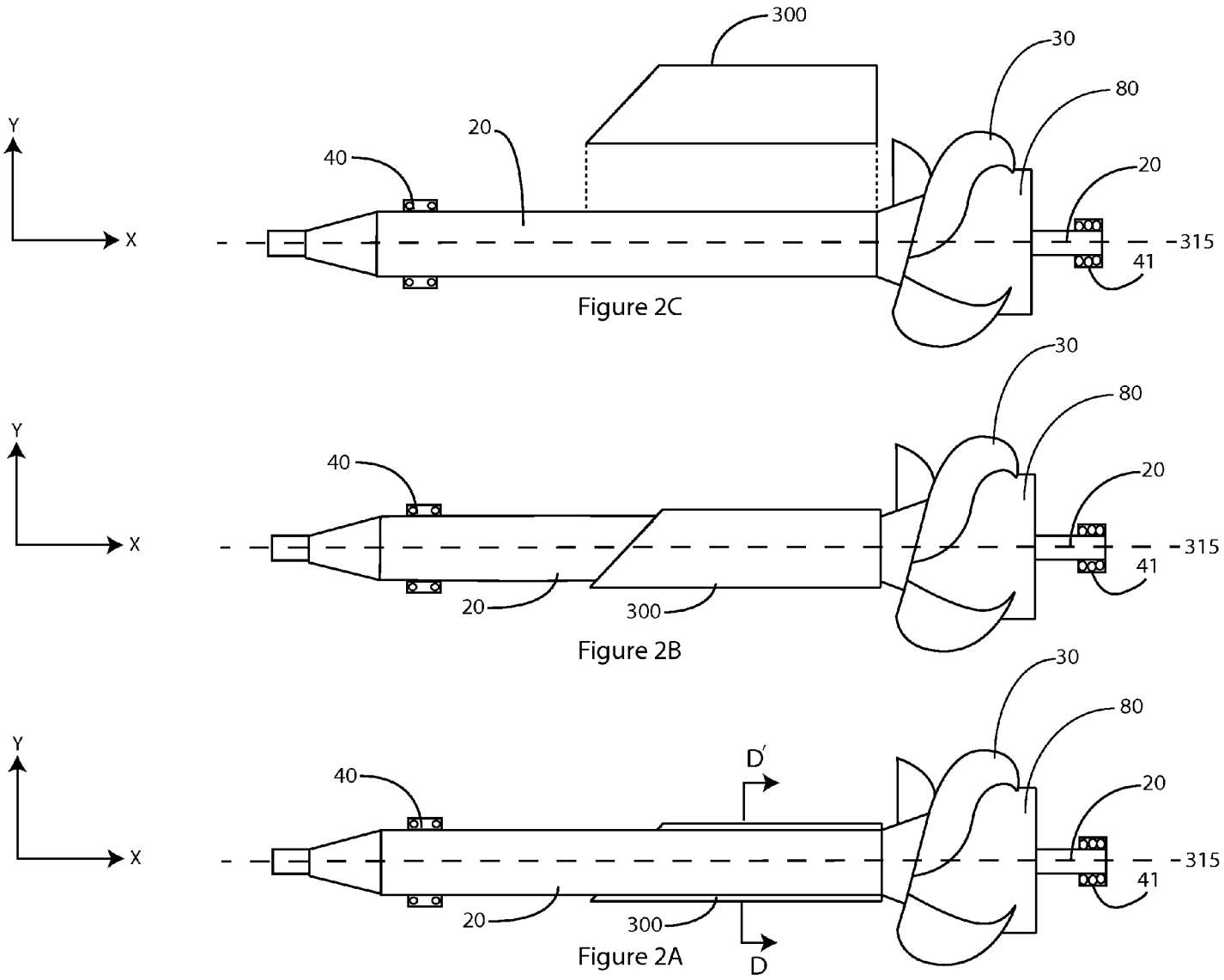
FIGS. 2A-2C are exemplary illustrations of an elongated sleeve and an impeller assembly, according to an embodiment of the invention.

FIGS. 2A-2C are exemplary illustrations of an elongated sleeve 300 and an impeller assembly, according to an embodiment of the invention. FIGS. 2A-2C all show the impeller shaft 20 mounted on forward and aft impeller bearing arrangements (40, 41). FIGS. 2A-2C also show the impeller blade assembly having a central hub 80 and a plurality of blades 30 attached to the central hub 80. Also shown is longitudinal axis 315 in the X-direction, which extends through the impeller shaft 20. In operation, the impeller shaft 20 is substantially parallel to the longitudinal axis 315, and by means of the bearings (40, 41), rotates about the axis 315. As stated above, the longitudinal axis 315 extends in the X-direction. FIG. 2A is an exemplary perspective sectional, showing the elongated sleeve positioned over the shaft 20. FIG. 2B is an exemplary side view, showing the elongated sleeve 300 positioned over the shaft 20. FIGS. 2A and 2B are different views of the same arrangement. FIG. 2C shows the shaft 20 with the sleeve 300 removed.

Figure 2D:
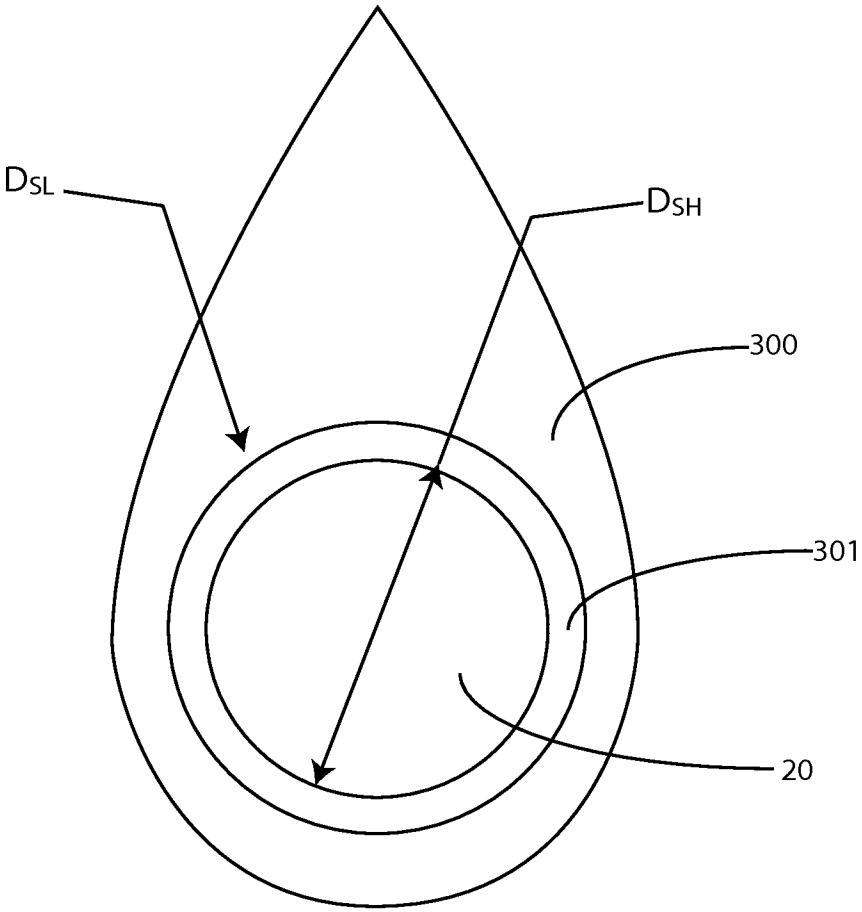
FIG. 2D is an exemplary sectional illustration of an elongated sleeve positioned over an impeller shaft, according to an embodiment of the invention

FIG. 2D is an exemplary sectional illustration, showing a section through D-D' of in the illustration of FIG. 2A. As stated above, turbulence may be introduced into the propulsor 100 because the shaft 20 extends into the intake flow path $F_I$. The circular sectional shape of the shaft 20 and the rotational movement of the shaft contribute to inefficiencies. As outlined below, the elongated sleeve 300 reduces deleterious flow effects by streamlining the flow $F_I$ over the impeller shaft 20. FIG. 2D shows a running clearance 301 between the sleeve 300 and the shaft 20 on account of the difference between the shaft diameter $D_{SH}$ and the sleeve diameter $D_{SL}$. As shown, the elongated sleeve 300 has an inner diameter $D_{SL}$ that is slightly larger than the outer diameter $D_{SH}$ of the impeller shaft. The running clearance 301 (shown exaggerated for clarity) facilitates a free-floating arrangement between the elongated sleeve 300 and the impeller shaft 20, allowing for the self-alignment of the sleeve 300 with the intake flow $F_I$. As outlined below, this free-floating adjustability is in the Y-Z plane. According to an embodiment of the invention, the sleeve 300 may be manufactured via CNC milling of a monolithic block of homogeneous and easily machinable material. This material would be durable, impact resistant, self-lubricating and would have a low friction coefficient, which ensures that the sleeve floats and self-aligns. These characteristics preclude the need to incorporate separate bearing components between the shaft 20 and the sleeve 300. The sleeve material may be an ultra-high molecular weight polyethylene (UHMWPE), or the like. The inherent properties of this material meet or exceed the above-outlined characteristics.

In operation, water fills the running clearance 301 and acts as a lubricant, further facilitating the free-floating of the elongated sleeve 300 on the shaft 20. The shaft 20 is also freely rotatable within the sleeve 300. Axial movement of the elongated sleeve 300 along the shaft 20 is prevented by abutment portions 51 (shown in FIG. 1) of the frame structure 50 at the forward end of the sleeve 300, and by the impeller hub 80 at the aft end of the sleeve 300. As outlined below with respect to FIGS. 4A and 4B, this free-floating arrangement allows for the automatic rotational alignment of the elongated sleeve 300 (self-alignment) with respect to Z-direction vectors in the intake flow $F_I$, automatically adjusting to variations in the intake flow path. The drag friction created by flow over the elongated sleeve 300 forces the self-alignment of the elongated sleeve 300 in a manner similar to how a weather anemometer self-aligns to the wind. FIG. 3A is an exemplary illustration of an elongated sleeve 300, showing the angular relation between the elongated sleeve 300 and the intake flow path $F_{I\text{-}xy}$, according to an embodiment of the invention. The intake flow $F_{I\text{-}xy}$ shown in FIG. 3A represents the flow vectors in the X-Y plane. FIG. 3A also shows a longitudinal axis 315 extending longitudinally (in the X-direction) through the center of an opening 305 (shown in FIG. 3B). FIG. 3B shows a sectional view through B-B' of the elongated sleeve 300, taken normal to axis 315, representing a view in the Y-Z plane. The illustrated section $\mathbf{300}_B$ shows the elongated sleeve 300 having an airfoil profile with a circular opening 305 for receiving the shaft 20 therethrough.

Figure 3C:
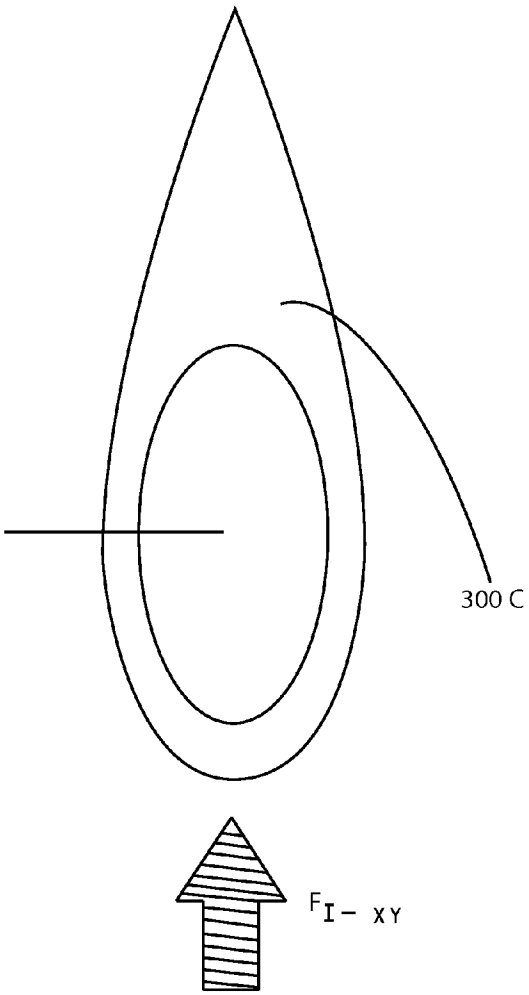
FIG. 3C is an exemplary sectional taken through line C-C' of FIG. 3A, according to an embodiment of the invention.
Figure 3D:
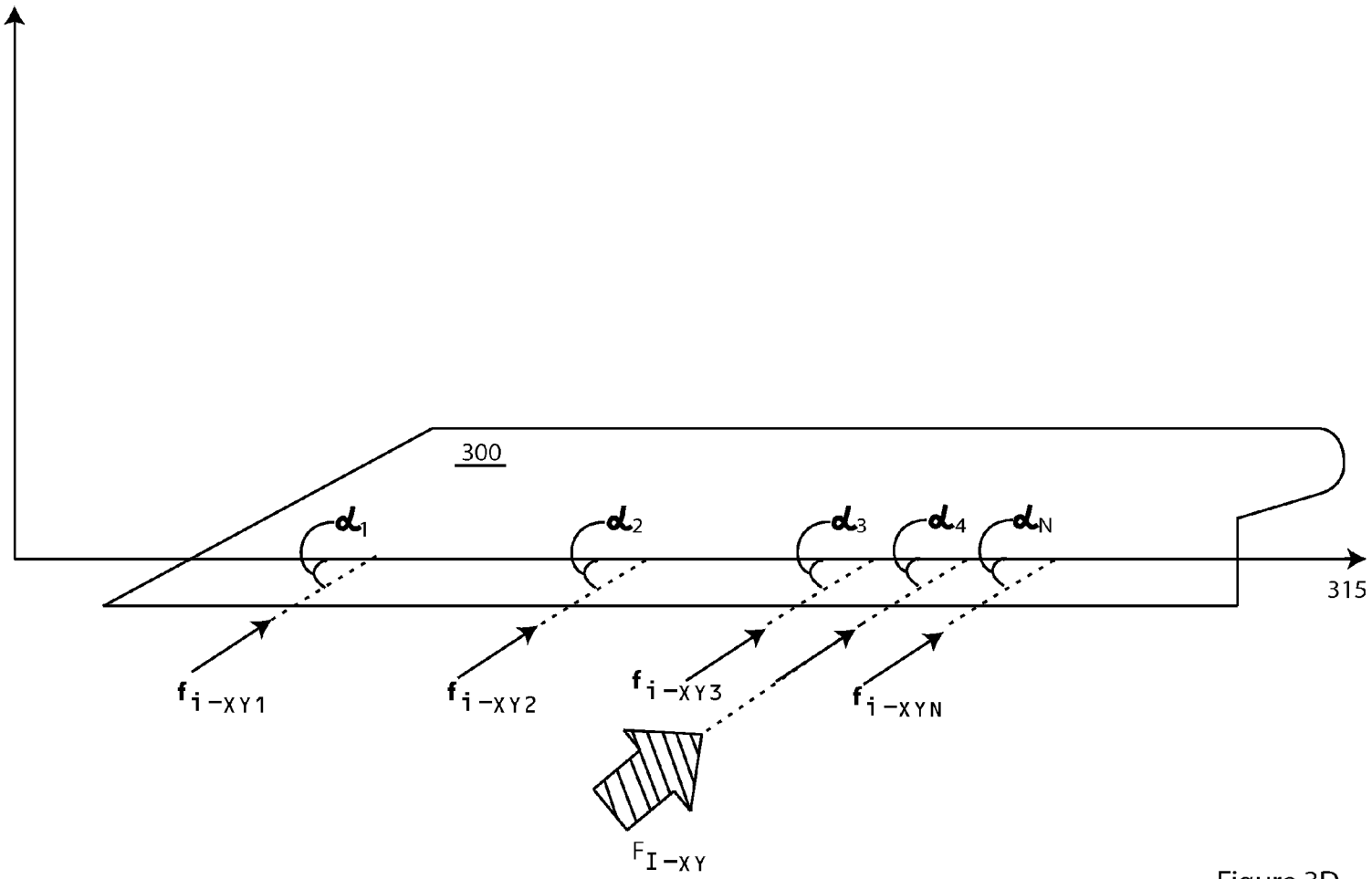
FIG. 3D is an exemplary explanatory illustration of the intake flow approaching the elongated sleeve, according to an embodiment of the invention.

Returning to FIG. 3A, as shown, the intake flow $F_{I\text{-}xy}$ approaches the sleeve 300 at an angle $\alpha$ with respect to the longitudinal axis 315. FIG. 3C shows a sectional view through C-C' of sleeve 300, taken at the angle $\alpha$ at which the intake flow $F_{I\text{-}xy}$ approaches the sleeve 300. The illustrated section $\mathbf{300}_C$ is an offset streamlined section defined by the path taken by the intake flow $F_{I\text{-}xy}$ as it travels over the elongated sleeve 300. In other words, the section $\mathbf{300}_C$ is an offset airfoil section that coincides with the intake flow direction. According to an embodiment of the invention, the section 300*c* may have a NACA 0030 profile. It should be noted that the intake flow $F_{I\text{-}xy}$ and angle $\alpha$, as illustrated, is representative of a plurality of flow components ($f_{i\text{-}xy1}$, $f_{i\text{-}xy2}$, $f_{i\text{-}xy3}$ . . . $f_{i\text{-}xyN}$) and corresponding angles ($\alpha_1$, $\alpha_2$, $\alpha_3$ . . . $\alpha_N$), where 'N' is an integer. FIG. 3D shows these flow components and angles, and is an explanatory illustration of the intake flow $FI_{\text{-}xy}$ approaching the elongated sleeve 300, according to an embodiment of the invention. Because of the orientation of the intake walls 172 and conduit 175 formed there between, in operation each flow component ($f_{i\text{-}xy1}$, $f_{i\text{-}xy2}$, $f_{i\text{-}xy3}$ . . . $f_{i\text{-}xyN}$) approaches at respective ($\alpha_1$, $\alpha_1$, $\alpha_1$ . . . $\alpha_N$) angles. The ($\alpha_1$, $\alpha_2$, $\alpha_3$ . . . $\alpha_N$) angles may vary along the length of the elongated sleeve 300, however the path of each component is generally as illustrated in FIG. 3C. Thus, regardless of the actual value of each ($\alpha_1$, $\alpha_2$, $\alpha_3$ . . . $\alpha_N$) angle, each flow component follows an offset streamlined airfoil path as shown in FIG. 3C, as opposed to the more squat and less streamlined cross section shown in FIG. 3B. This offset streamlined airfoil path minimizes the deleterious flow effects caused by the shaft, and improves the efficiency of the propulsor.

As stated above regarding the illustrations of FIGS. 1 and 3A, the intake flow $F_{i\text{-}xy}$ shown represents the flow vectors in the X-Y plane. The elongated sleeve 300 has a short and squat airfoil section in the Y-Z plane, but because of the intake flow angle $\alpha$, the intake flow $F_{I\text{-}xy}$ follows the offset streamlined airfoil path $\mathbf{300}_C$ as shown in FIG. 3C. This offset streamlined airfoil path minimizes the deleterious flow effects caused by the shaft, and improves the efficiency of the propulsor. However, additional alignment is required to accommodate for Z-direction flow vectors. This additional alignment is necessary to optimize the flow over the elongated sleeve 300, and in particular, to optimize the flow in the offset streamlined airfoil path.

Figure 4B:
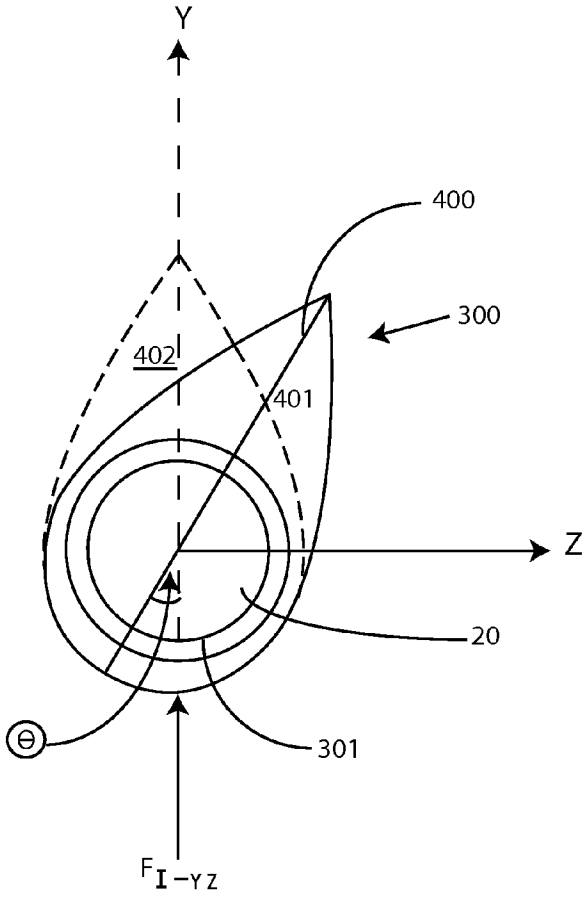
FIGS. 4A-4B are explanatory illustrations demonstrating the angular alignment of the elongated sleeve, according to an embodiment of the invention.
Figure 4A:
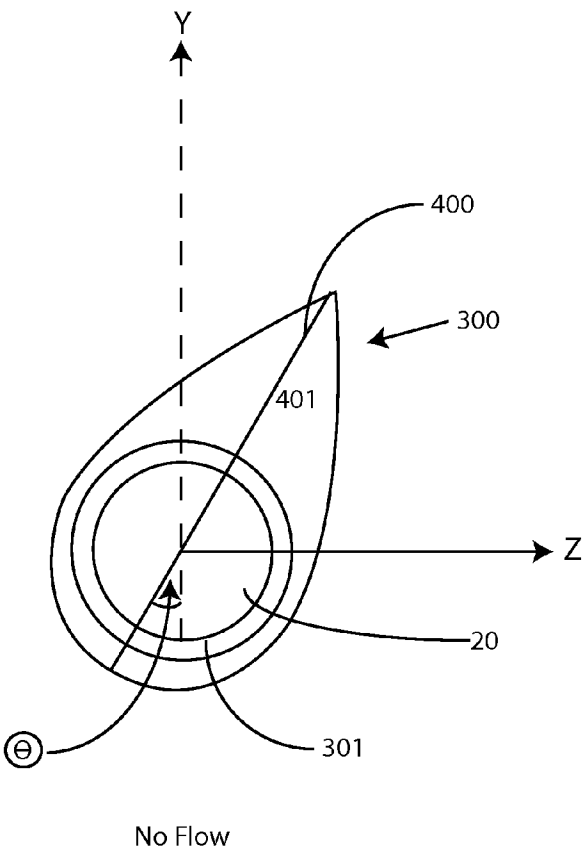

FIGS. 4A-4B are explanatory illustrations demonstrating the angular alignment of the elongated sleeve 300, according to an embodiment of the invention. More specifically, FIGS. 4A-4B show the elongated sleeve 300 over the shaft 20. FIGS. 4A-4B also show the running clearance 301 between the shaft 20 and the sleeve 300, which allows for rotational adjustments. The FIG. 4A-4B illustrations are in the Y-Z plane and thus, the views show the section $\mathbf{300}_B$ of the elongated sleeve 300, and the rotational adjustment necessary to correct for variations of the intake flow $F_{I\text{-}yz}$ in the Y-Z plane. Rotational adjustments are performed by the self-alignment of the elongated sleeve 300 due to the friction drag forces created by the intake flow $F_I$.

FIG. 4A shows the sleeve 300 in an initial position 401 with respect to the Y and Z axes, as might be the case when the waterjet is not operational and there is no intake flow $F_I$ present. Once put into operation, the resulting incident intake flow $F_{I\text{-}yz}$ impinges on the elongated sleeve 300 as shown in FIG. 4B. When the sleeve 300 is in the initial position 401, the elongated sleeve is not aligned with the intake flow $F_{I\text{-}yz}$, and thus, the flow over the airfoil section is not optimized to reduce turbulence. As shown, the incident intake flow $F_{I\text{-}yz}$ approaches the sleeve 300 at an angle of attack corresponding to the angle θ between the $F_{I\text{-}yz}$ direction and a chord line 400. As shown, the chord line 400 extends from the apex of the section, through the midpoint of the circular opening 305 to the base of the section. For optimized flow over the sleeve, the angle θ between the incident intake flow $F_{I\text{-}yz}$ and the chord line 400 should be zero. To achieve this, the sleeve 300 must rotate θ degrees to the adjusted position 402, shown in dotted lines in FIG. 4B. This adjusted position optimizes the flow over the elongated sleeve 300, and specifically the flow path defined by the offset streamlined airfoil cross section $\mathbf{300}_C$, thereby minimizing flow interruptions. It should be noted that although FIG. 4B shows the angular adjustment θ from position 401 to position 402 as a counter-clockwise adjustment, adjustments may be made in any direction to adjust for misalignment of elongated sleeve 300 with the intake flow $F_{I\text{-}yz}$. Alternatively, depending on the position of elongated sleeve 300, no adjustment may be necessary, so θ may be zero.

As stated above, and as illustrated in FIG. 2D, the elongated sleeve 300 is in a free-floating arrangement with respect to the shaft 20. In operation, the elongated sleeve 300 self-aligns to make the angular adjustment θ from position 401 to position 402. As outlined with respect to FIG. 2D, the operating fluid in the running clearance 301 acts as a lubricant during the aligning movements of the free-floating elongated sleeve 300. The self-aligning function is achieved due to the friction drag forces created by the intake flow $F_I$. Consequently, during operation, the free-floating arrangement allows for continuous adjustments due to any variation in the intake flow $F_I$.

Figure 5:
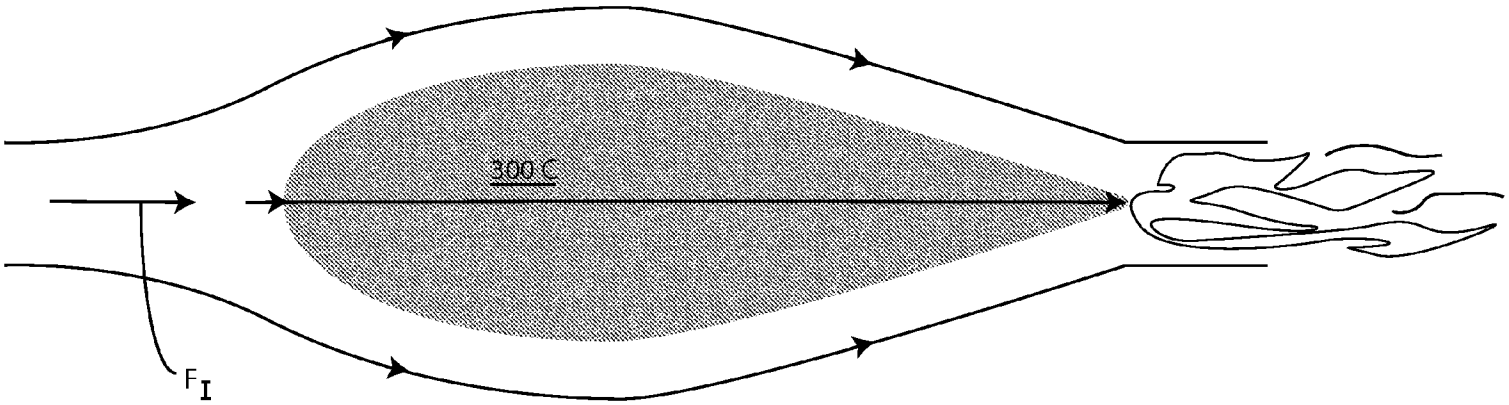
FIG. 5 is an exemplary sectional illustration of the flow over the elongated sleeve, according to an embodiment of the invention.

FIG. 5 is an exemplary sectional illustration of the flow over the elongated sleeve, according to an embodiment of the invention. More specifically, FIG. 5 shows the flow of water over the airfoil section $\mathbf{300}_C$ at offset angle α, and at adjusted angle θ. Because of the geometry of the elongated sleeve 300, and also because of the ability to adjust rotationally as shown in FIG. 4, the flow over the airfoil section is as illustrated in FIG. 5. The resulting streamlined flow over the airfoil section results in the reduction of drag. The reduction in drag has the benefit of reducing upstream flow influence. There is also a resulting decrease in the magnitude of the fatigue environment, as well as a decrease in pressure variations, thereby reducing radiated noise. An additional benefit is the increase in mass flow through the nozzle 70, increasing the efficiency of the propulsor. This results in increased thrust, increased craft speed, and an increased cavitation inception margin.

Figure 6:
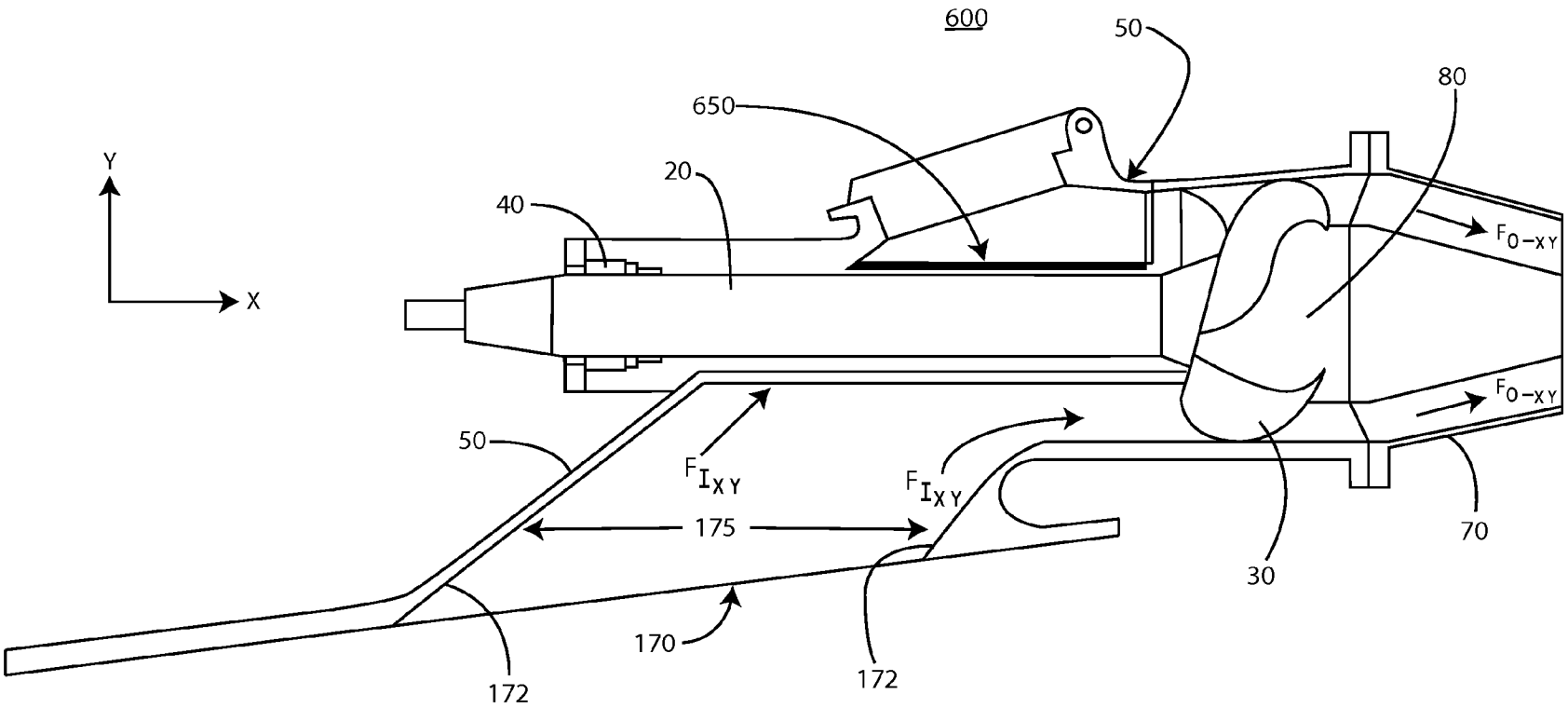
FIG. 6 is an exemplary illustration of an optimized waterjet propulsor 600, according to an embodiment of the invention.

FIG. 6 is an exemplary illustration of an optimized waterjet propulsor 600, according to an embodiment of the invention. The arrangement of the waterjet propulsor 600 is similar to that of illustration in FIG. 1. Consequently, like elements in FIG. 6 are numbered to correspond to like elements shown in FIG. 1. For example, as shown in FIG. 6, element 20 is also a propulsor shaft, element 40 is also a forward bearing arrangement, and element 41 is also an aft bearing arrangement, the bearings (40, 41) for supporting and rotating the shaft 20. However, instead of an elongated sleeve, the waterjet propulsor 600 includes a rigid elongated structure 650 attached to the frame 50 and extending from the forward end of the frame towards impeller blade assembly. The elongated structure 650 may be attached to the frame 50 or may be integrally formed with the frame 50. Because the elongated structure 650 is rigidly attached to the frame 50, the elongated structure 650 is not rotatable.

Figure 7A:
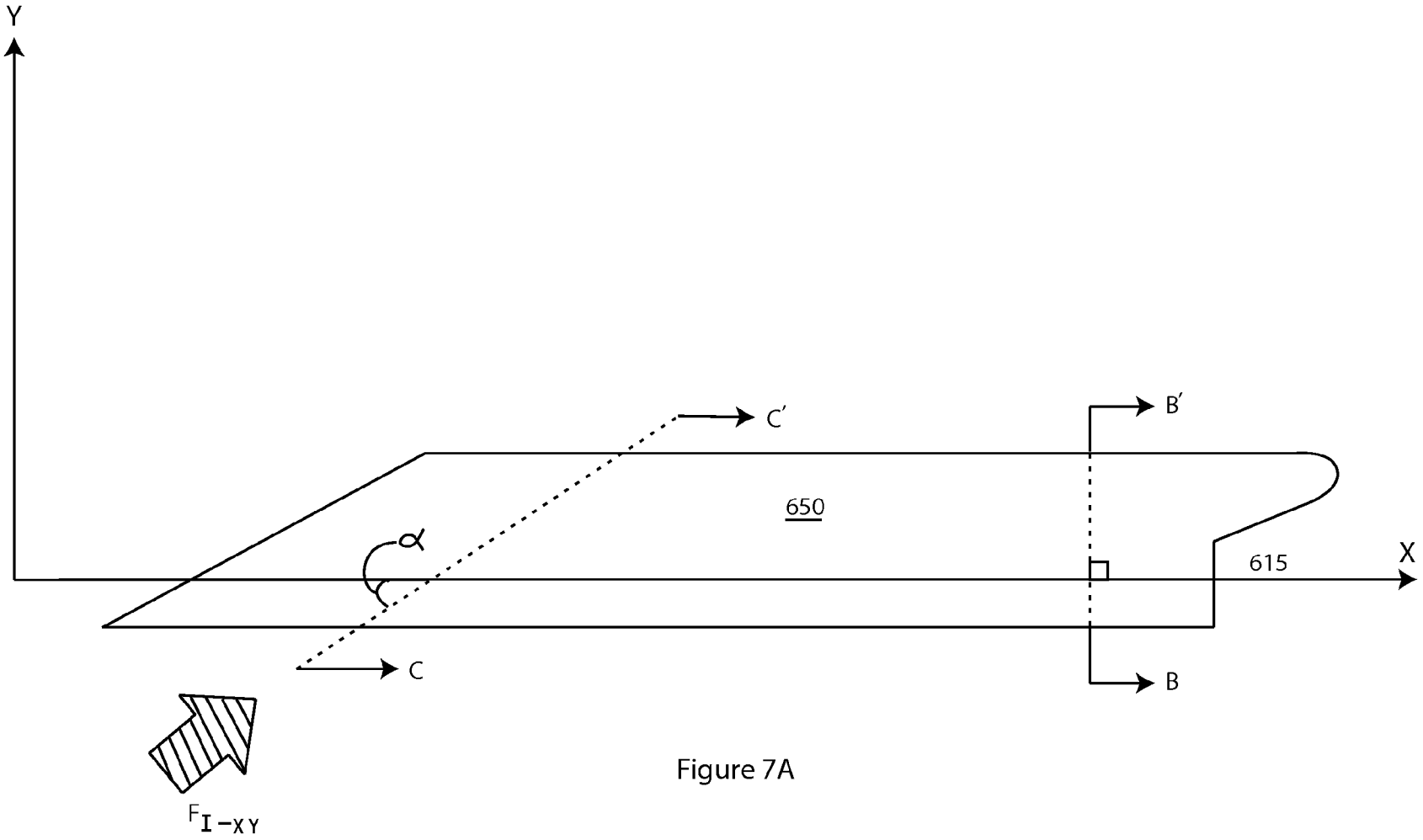
FIG. 7A is an exemplary illustration of an elongated structure, according to an embodiment of the invention.
Figure 7B:
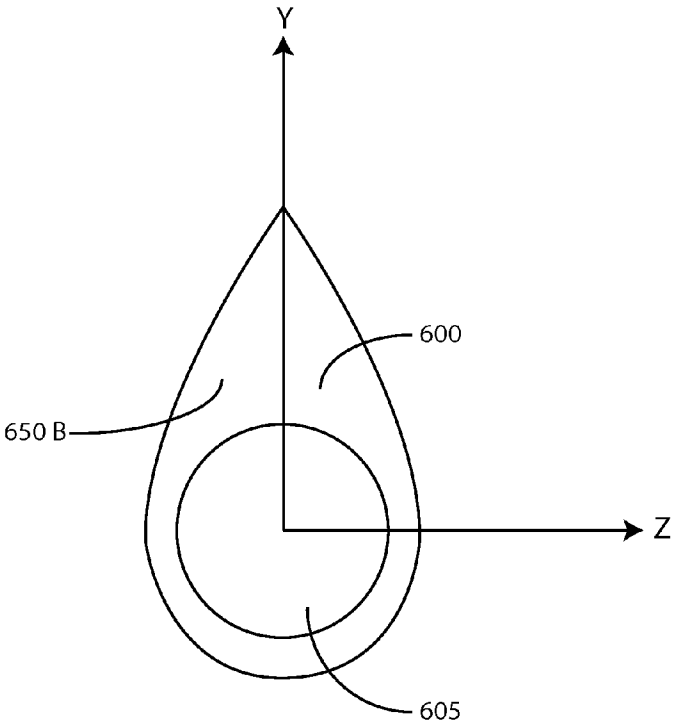
FIG. 7B is an exemplary sectional illustration through B-B' of FIG. 7A, according to an embodiment of the invention.

FIG. 7A is an exemplary illustration of an elongated structure 650, showing the angular relation between the elongated structure 650 and the intake flow path $F_{i\text{-}xy}$, according to an embodiment of the invention. The illustration of FIG. 7A is similar to that of FIG. 3A, and thus the FIG. 7A features for optimizing the flow are similar to those outlined previously with respect to FIG. 3A. The intake flow $F_{i\text{-}xy}$ shown in FIG. 7A represents the flow vectors in the X-Y plane. FIG. 7B shows a sectional view through B-B' of the rigid elongated structure 650, taken normal to axis 615 (shown in FIG. 7A) which extends in the X-direction, representing a view in the Y-Z plane. The illustrated section $\mathbf{650}_B$ shows the elongated structure 650 having an airfoil profile with a circular opening 605 for receiving the shaft 20 therethrough.

Figure 7C:
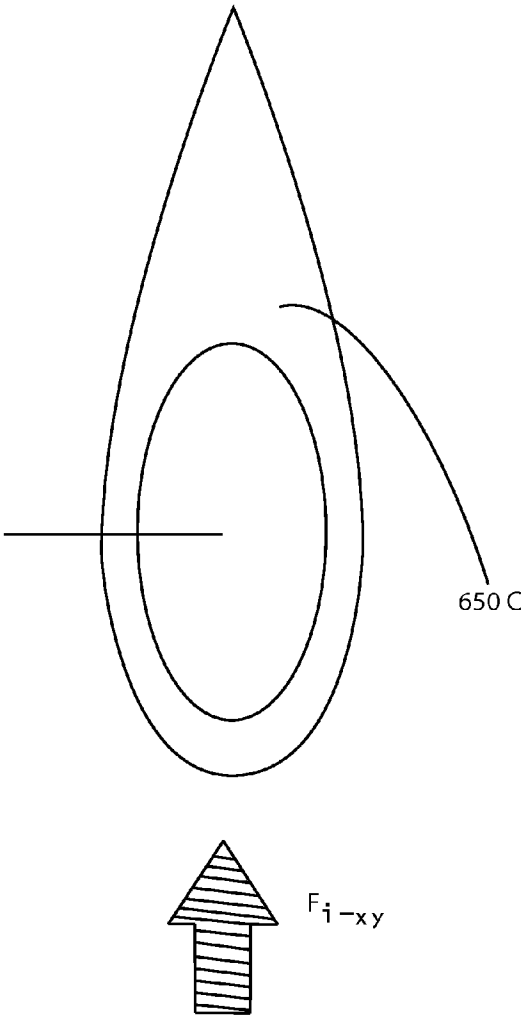
FIG. 7C is an exemplary sectional illustration through C-C' of FIG. 7A, according to an embodiment of the invention.
Figure 8A:
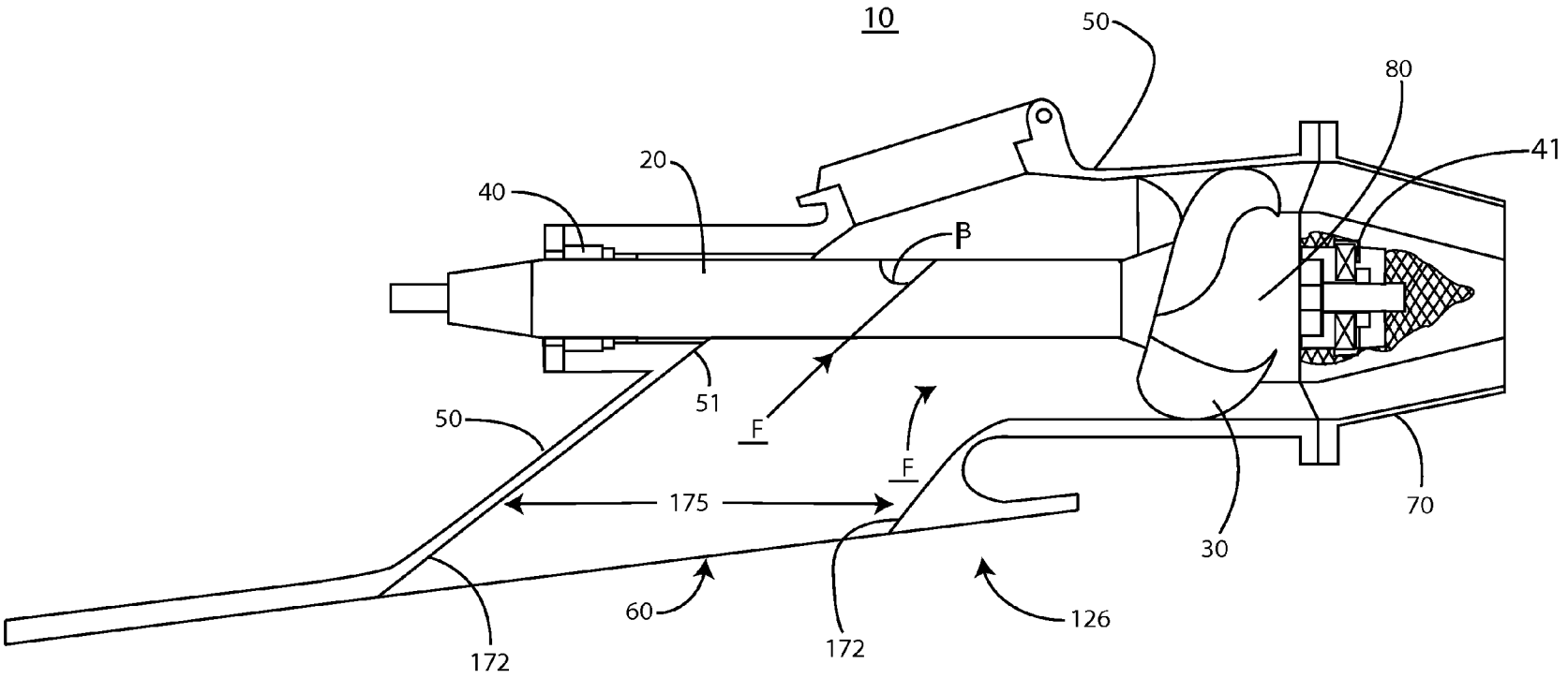
Figure 8A (Prior Art)
FIG. 8A is a prior art illustration of a waterjet propulsor.
Figure 8B:
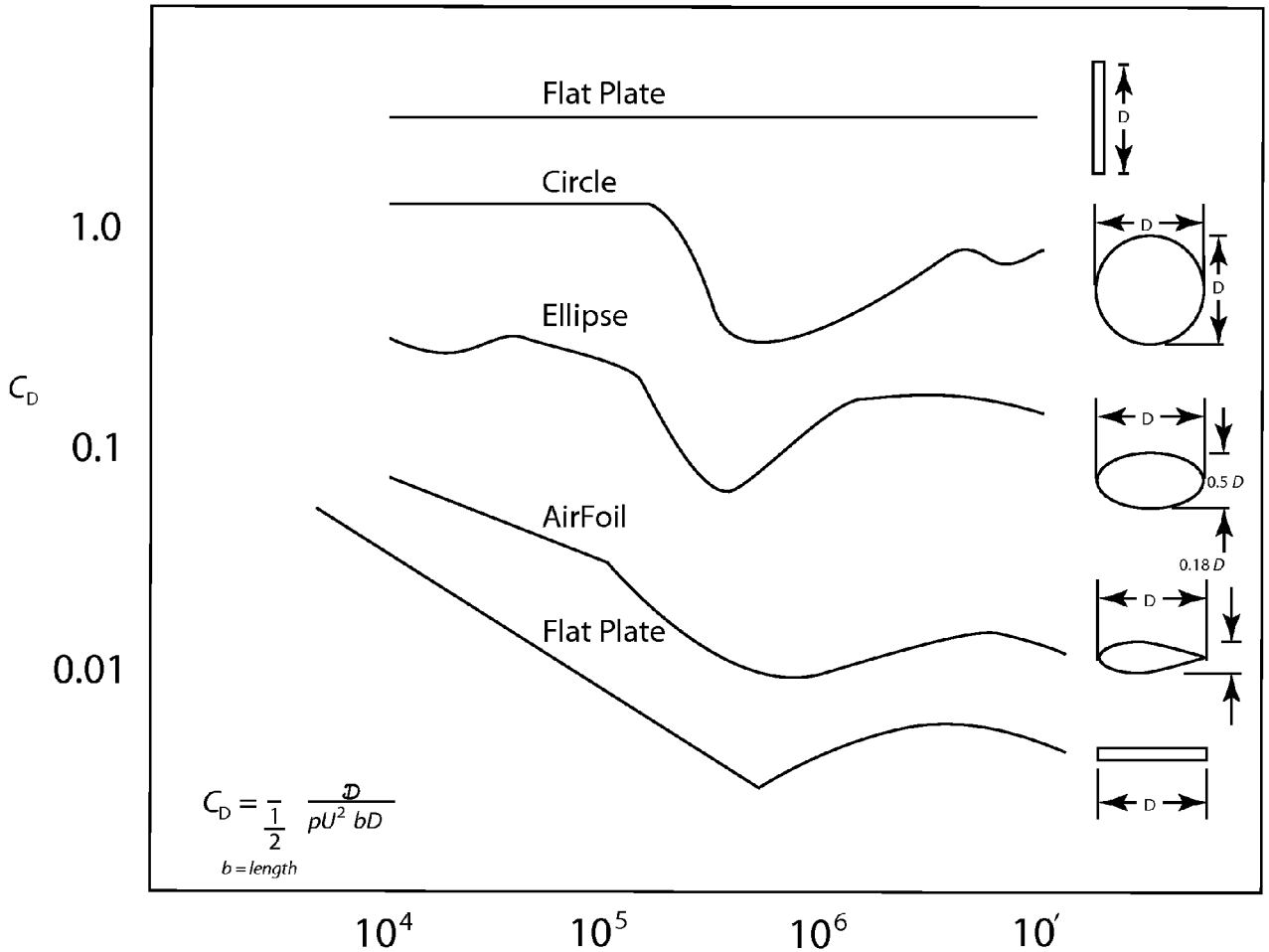
Figure 8B Prior Art
FIG. 8B shows the typical fluid flow over streamlined objects of different cross sectional shapes, including that of a circle and an ellipse.

Returning to FIG. 7A, as shown, the intake flow $F_{i\text{-}xy}$ approaches the elongated structure 650 (which covers the shaft 20) at an angle α with respect to the longitudinal axis 615. FIG. 7C shows a sectional view through C-C' of elongated structure 650, taken at the angle α at which the intake flow F-x, approaches the elongated structure 650. The illustrated section $\mathbf{650}_C$ is an offset streamlined section defined by the path taken by the intake flow $F_{i\text{-}xy}$ as it travels over the elongated structure 650. In other words, the section $\mathbf{650}_C$ is an offset airfoil section that coincides with the intake flow direction. According to an embodiment of the invention, the offset streamlined section may have a NACA 0030 profile. It should be noted that the intake flow $F_{i\text{-}xy}$ and angle α, as illustrated, is representative of a plurality of flow components ($f_{i\text{-}xy1}$, $f_{i\text{-}xy2}$, $f_{i\text{-}xy3}$ . . . $f_{i\text{-}xyN}$) and corresponding angles ($\alpha_1$, $\alpha_2$, $\alpha_3$ . . . $\alpha_N$), where 'N' is an integer, as outlined above with respect to FIG. 3D. Thus, the explanation of the flow with respect to FIG. 3D, also applies here. It should also be noted because of the arrangement outline in FIG. 6, the intake flow is takes the path defined by the offset streamlined section 650C, similar to what is illustrated in FIG. 5. This minimizes the deleterious flow effects caused by the shaft and increases the efficiency of the propulsor.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A waterjet propulsor comprising:

a frame having a forward end, an aft end, an upper end, and a lower end;

a nozzle assembly located at the aft end of the frame;

an impeller assembly comprising;

a forward impeller bearing arrangement at the forward end of the frame;

an aft impeller bearing arrangement at the aft end of the frame;

an impeller shaft extending from the forward end of the frame to the aft end of the frame in a longitudinal direction X and mounted within each of the forward impeller bearing arrangement and the aft impeller bearing arrangement; and an impeller blade assembly comprising a central hub and a plurality of blades attached to the central hub, wherein the central hub is supported on the impeller shaft;

a water intake extending from the lower end of the frame towards the impeller, the water intake having intake walls forming a conduit, wherein the conduit is angled to create an intake flow $F_I$ having flow vectors in perpendicular X, Y, and Z axes, and wherein intake flow $F_{I\text{-}xy}$ in the X-Y plane impinges on the impeller shaft at an angle $\alpha$ with respect to the longitudinal direction X of the shaft;

an elongated structure positioned over the impeller shaft, wherein the elongated structure has an airfoil cross section in the Y-Z plane, the elongated structure further comprising an offset streamlined airfoil cross section aligned with the intake flow angle $\alpha$, so that the intake flow $F_{I\text{-}xy}$ flows over the elongated structure in a path defined by the offset streamlined airfoil cross section, thereby minimizing the deleterious flow effects caused by the shaft, and increasing the efficiency of the propulsor.

2. The waterjet propulsor of claim 1, wherein the elongated structure is an elongated sleeve positioned over the impeller shaft so that the impeller shaft and the elongated sleeve are freely rotatable with respect to each other.

3. The waterjet propulsor of claim 2, wherein the elongated sleeve is mounted over the impeller shaft in a free-floating arrangement wherein the elongated sleeve has an inner diameter $D_{SL}$ that is larger than the outer diameter of the impeller shaft $D_{SH}$, and wherein in operation there is a running clearance between the elongated sleeve and the impeller shaft because of the difference in diameters, the running clearance filled with water from the intake flow $F_I$ acting as a lubricant between the elongated sleeve and the impeller shaft, and wherein the elongated sleeve is positioned on the impeller shaft between an abutment portion of the frame and the impeller blade assembly to prevent axial movement of the elongated sleeve along the impeller shaft.

4. The waterjet propulsor of claim 3, wherein the elongated sleeve is rotatably adjustable to adjust for the intake flow $F_{I\text{-}yz}$ in the Y-Z plane, and wherein when the intake flow $F_{I\text{-}yz}$ contacts the elongated sleeve at an angle $\theta$ with respect to a chord of the airfoil cross section, the elongated sleeve rotates by an angle of about $\theta$ to ensure that the angle between the intake flow and the chord is zero, thereby aligning the elongated sleeve with intake flow.

5. The waterjet propulsor of claim 1, wherein the elongated structure is rigidly attached to the frame, extending from the forward end of the frame towards impeller blade assembly.

6. A method of optimizing the flow within a waterjet propulsor, the method comprising:

providing a waterjet propulsor comprising:

a frame having a forward end, an aft end, an upper end, and a lower end;

a nozzle assembly located at the aft end of the frame;

an impeller assembly comprising;

a forward impeller bearing arrangement at the forward end of the frame;

an aft impeller bearing arrangement at the aft end of the frame;

an impeller shaft extending from the forward end of the frame to the aft end of the frame in a longitudinal direction X and mounted within each of the forward impeller bearing arrangement and the aft impeller bearing arrangement; and an impeller blade assembly comprising a central hub and a plurality of blades attached to the central hub, wherein the central hub is supported on the impeller shaft;

a water intake extending from the lower end of the frame towards the impeller, the water intake having intake walls forming a conduit, wherein the conduit is angled to create an intake flow $F_I$ having flow vectors in perpendicular X, Y, and Z axes;

providing an elongated structure positioned over the impeller shaft, wherein the elongated structure has an airfoil cross section in the Y-Z plane;

directing the intake flow $F_I$ having intake flow vector $F_{I\text{-}xy}$ in the X-Y plane into the waterjet propulsor, the intake flow $F_{I\text{-}xy}$ impinging on the impeller shaft at an angle $\alpha$ with respect to the longitudinal direction X of the shaft, wherein the elongated structure further comprises an offset streamlined airfoil cross section aligned with the intake flow angle $\alpha$, so that the intake flow $F_{I\text{-}xy}$ flows over the elongated structure in a path defined by offset streamlined airfoil cross section, thereby minimizing the deleterious flow effects caused by the shaft, and increasing the efficiency of the propulsor.

7. The method of optimizing the flow of claim 6, wherein the elongated structure is an elongated sleeve, the method further comprising positioning the elongated sleeve over the impeller shaft so that the impeller shaft and the elongated sleeve are freely rotatable with respect to each other.

8. The method of optimizing the flow of claim 7, wherein in the positioning of the elongated sleeve over the impeller shaft, the impeller shaft is provided in a free-floating arrangement wherein the elongated sleeve has an inner diameter $D_{SL}$ that is larger than the outer diameter of the impeller shaft $D_{SH}$, and wherein there is a running clearance between the elongated sleeve and the impeller shaft because of the difference in diameters, the running clearance filled with water from the intake flow $F_I$ acting as a lubricant between the elongated sleeve and the impeller shaft, and wherein the elongated sleeve is positioned on the impeller shaft between an abutment portion of the frame and the impeller blade assembly to prevent axial movement of the elongated sleeve along the impeller shaft.

9. The method of optimizing the flow of claim 8, wherein the elongated sleeve is provided to be rotatably adjustable to adjust for the intake flow $F_{I\text{-}yz}$ in the Y-Z plane, and wherein when the intake flow $F_{I\text{-}yz}$ contacts the elongated sleeve at an angle $\theta$ with respect to a chord of the airfoil cross section, the elongated sleeve rotates by an angle of about $\theta$ to ensure that the angle between the intake flow and the chord is zero, thereby aligning the elongated sleeve with intake flow.

10. The method of optimizing the flow of claim 6, wherein the elongated structure is rigidly attached to the frame, extending from the forward end of the frame towards impeller blade assembly.

11. An elongated sleeve for optimizing an airflow in a waterjet propulsor having a frame with a forward end, an aft end, an upper end, and a lower end, a nozzle assembly located at the aft end of the frame, and an impeller assembly comprising a forward impeller bearing arrangement at the forward end of the frame, an aft impeller bearing arrangement at the aft end of the frame, an impeller shaft extending from the forward end of the frame to the aft end of the frame in a longitudinal direction X and mounted within each of the forward impeller bearing arrangement and the aft impeller bearing arrangement, and an impeller blade assembly comprising a central hub and a plurality of blades attached to the central hub, wherein the central hub is supported on the impeller shaft, the waterjet propulsor further comprising a water intake extending from the lower end of the frame towards the impeller, the water intake having intake walls forming a conduit, wherein the conduit is angled to create an intake flow $F_I$ having flow vectors in perpendicular X, Y, and Z axes, and wherein intake flow $F_{I\text{-}xy}$ in the X-Y plane impinges on the impeller shaft at an angle $\alpha$ with respect to the longitudinal direction X of the shaft, the elongated sleeve positioned over the impeller shaft and having:

an airfoil cross section in the Y-Z plane, the elongated sleeve further comprising an offset streamlined airfoil cross section with a NACA 0030 profile aligned with the intake flow angle $\alpha$, so that the intake flow $F_{I\text{-}xy}$ flows over elongated sleeve in a path defined by offset streamlined airfoil cross sections, thereby minimizing the deleterious flow effects caused by the shaft, and increasing the efficiency of the propulsor.

12. The elongated sleeve of claim 11, wherein the elongated sleeve is mounted over the impeller shaft in a free-floating arrangement wherein the elongated sleeve has an inner diameter $D_{SL}$ that is larger than the outer diameter of the impeller shaft $D_{SH}$, and wherein in operation there is a running clearance between the elongated sleeve and the impeller shaft because of the difference in diameters, the gap filled with water from the intake flow $F_I$ acting as a lubricant between the elongated sleeve and the impeller shaft, and wherein the elongated sleeve is positioned on the impeller shaft between an abutment portion of the frame and the impeller blade assembly to prevent axial movement of the elongated sleeve along the impeller shaft.

13. The elongated sleeve of claim 12, wherein the elongated sleeve is rotatably adjustable to adjust for the intake flow $F_{I\text{-}xy}$ in the Y-Z plane, and wherein when the intake flow $F_{I\text{-}xy}$ contacts the elongated sleeve at an angle $\theta$ with respect to a chord of the airfoil cross section, the elongated sleeve rotates by an angle of about 0 to ensure that the angle between the intake flow and the chord is zero, thereby aligning the elongated sleeve with intake flow.

14. The waterjet propulsor of claim 4, wherein the elongated sleeve is an ultra-high molecular weight polyethylene, and the offset streamlined airfoil cross section is a NACA 0030 profile.

15. The waterjet propulsor of claim 5, wherein the offset streamlined airfoil cross section is a NACA 0030 profile.

16. The method of optimizing the flow of claim 9, wherein the elongated sleeve is an ultra-high molecular weight polyethylene, and the offset streamlined airfoil cross section is a NACA 0030 profile.

* * * * *